US012753714B2

(12) United States Patent
Barke et al.

(10) Patent No.: US 12,753,714 B2
(45) Date of Patent: Oct. 6, 2026

(54) MIXING TUBE FOR EXHAUST SYSTEM AND OPERATING STRATEGY FOR SAME

(71) Applicant: Caterpillar Inc., Peoria, IL (US)

(72) Inventors: Lance Clay Barke, Peoria, IL (US); Qiang Zhu, Wuxi City (CN); Douglas T. Scott, Rapid City, SD (US); Collin P. Hecker, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/980,661

(22) Filed: Dec. 13, 2024

(65) Prior Publication Data

US 2026/0168419 A1 Jun. 18, 2026

(51) Int. Cl.
*F01N 3/28* (2006.01)

(52) U.S. Cl.
CPC ..... *F01N 3/28* (2013.01)

(58) Field of Classification Search
CPC ..... F01N 2240/20; F01N 2470/24; F01N 3/2066; F01N 3/2892; F01N 13/009; F01N 13/011; F01N 2410/00; F01N 2450/40; F01N 2590/08; F01N 2610/01; F01N 2610/02; F01N 2610/03; F01N 2610/1453; F01N 3/021; F01N 3/10; F01N 3/206; F01N 3/208; B01F 2025/931; B01F 25/435
See application file for complete search history.

(56) References Cited

U.S. PATENT DOCUMENTS

| | | | | |
|---|---|---|---|---|
| 8,635,861 | B2 | 1/2014 | Caterpillar | |
| 10,188,994 | B2 | 1/2019 | Proventia | |
| 10,844,764 | B2 | 11/2020 | Donaldson | |
| 2014/0196440 | A1 * | 7/2014 | Katou | B01F 25/102 60/286 |
| 2015/0315948 | A1 | 11/2015 | Weiss et al. | |
| 2016/0326938 | A1 | 11/2016 | Zhang | |

FOREIGN PATENT DOCUMENTS

| | | | | |
|---|---|---|---|---|
| CN | 105089750 | B | 4/2018 | |
| CN | 112627951 | B | 11/2021 | |
| CN | 108757127 | B | 5/2024 | |
| DE | 102017213954 | A1 | 2/2019 | |
| WO | WO-2011147556 | A1 * | 12/2011 | F01N 3/2066 |
| WO | 2013188728 | A1 | 12/2013 | |
| WO | 2019140892 | A1 | 7/2019 | |

OTHER PUBLICATIONS

English Translation WO 2011147556 A1 (Year: 2012).*
Extended European Search report for EP Patent Application No. 25217857.9, mailed Mar. 30, 2026 (8 pgs).

* cited by examiner

*Primary Examiner* — Anthony Ayala Delgado
(74) *Attorney, Agent, or Firm* — Brannon Sowers & Cracraft PC

(57) ABSTRACT

An aftertreatment mixing tube includes a mixing tube body having an exhaust inlet located in a first tube end, an exhaust outlet located in a second tube end, and an inner tube surface circumferentially extending around a center axis and forming an exhaust passage. The mixing tube body further includes a diesel exhaust fluid (DEF) injection port positioned proximate to the first tube end. The mixing tube defines a mixing tube inner diameter dimension, and a mixing tube axial length dimension, and a ratio of the mixing tube axial length dimension to the mixing tube inner diameter dimension ranges from 5.9 to 6.7. An exhaust system and methodology of operating an aftertreatment system are also disclosed.

19 Claims, 5 Drawing Sheets

MIXING TUBE FOR EXHAUST SYSTEM AND OPERATING STRATEGY FOR SAME

TECHNICAL FIELD

The present disclosure relates generally to an exhaust system, and more particularly to an aftertreatment system having a mixing tube for targeted residence time to vaporize an injected fluid.

BACKGROUND

Reduction in certain emissions from internal combustion engines has been of interest for many years. Combustion of a fuel and air within engine cylinders produces a variety of emissions, including carbon monoxide, carbon dioxide, particulate matter including soot and ash, unburned hydrocarbons, and oxides of nitrogen or "NOx." Various regulations have been put in place over the years to limit output of certain emissions. Manufacturers of engines and related systems have devised a great many different strategies for limiting discharge especially of particulate matter and NOx to the environment.

With regard to particulate matter, it has become conventional to equip internal combustion engine systems with filtration equipment to trap particulates that would otherwise be discharged to ambient surroundings. Other components such as selective catalytic reduction (SCR) devices to limit NOx are used in aftertreatment systems and can make the overall system quite complex and expensive. Additionally, while proven effective, there are certain challenges SCR devices encounter, particularly regarding the atomization and vaporization of diesel exhaust fluid (DEF). In various applications, such as where spatial constraints are fairly severe, achieving efficient and complete vaporization of DEF becomes more difficult. Increasingly stringent emissions regulations, as well as expected new and different future regulations have further compounded such challenges. One example exhaust aftertreatment strategy is known from U.S. Pat. No. 10,188,994 to Tyni et al. While the concepts disclosed in this reference may work for intended purposes, there is always room for improvement and alternative strategies.

SUMMARY

In one aspect, an aftertreatment mixing tube includes a mixing tube body having an exhaust inlet located in a first tube end, an exhaust outlet located in a second tube end, and an inner tube surface circumferentially extending around a center axis and forming an exhaust passage. The mixing tube body further includes a diesel exhaust fluid (DEF) injection port positioned proximate to the first tube end. The mixing tube defines a mixing tube inner diameter dimension, and a mixing tube axial length dimension, and a ratio of the mixing tube axial length dimension to the mixing tube inner diameter dimension ranges from 5.9 to 6.7.

In another aspect, an exhaust system includes a housing, a catalyst bank located in the housing, and a mixing tube located in the housing and coupled to the catalyst bank. The mixing tube includes an exhaust inlet located in a first tube end, an exhaust outlet located in a second tube end, and an inner tube surface circumferentially extending around a center axis and forming an exhaust passage. The mixing tube further includes a diesel exhaust fluid (DEF) injection port positioned proximate to the first tube end. The mixing tube defines a mixing tube inner diameter dimension of about 400 millimeters or greater, and a mixing tube axial length dimension ranging from about 2595 millimeters to about 2615 millimeters.

In yet another aspect, a method of operating an aftertreatment system includes injecting diesel exhaust fluid (DEF) into exhaust passing through an aftertreatment mixing tube defining a center axis, an axial length dimension defined parallel to the center axis, an inner diameter dimension defined normal to the axial length dimension, and a ratio of the mixing tube axial length dimension to the mixing tube inner diameter dimension ranging from 5.9 to 6.7. Operating the aftertreatment system further includes feeding a flow of the exhaust and injected DEF toward an exhaust outlet of the aftertreatment mixing tube fluidly connected to a first catalyst bank and a second catalyst bank, and increasing mixing of the exhaust and injected DEF at least in part by impinging a flow of the exhaust and injected DEF upon a plurality of exhaust impingement surfaces serially arranged between an exhaust inlet and the exhaust outlet of the aftertreatment mixing tube.

DETAILED DESCRIPTION

Figure 1:
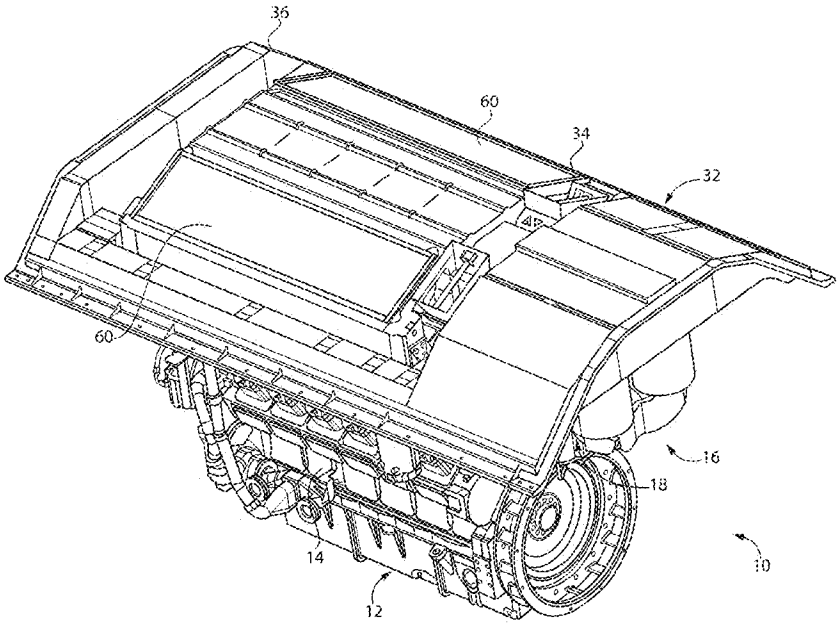
FIG. 1 is a perspective view of an internal combustion engine system having an exhaust system, according to one embodiment.
Figure 2:
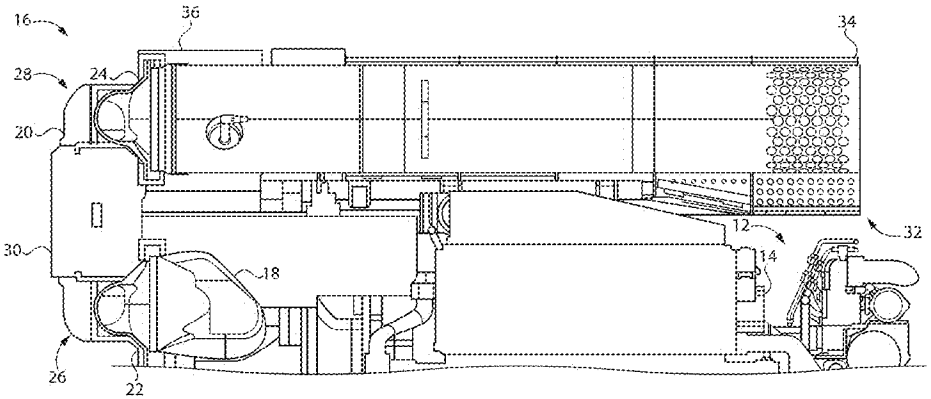
FIG. 2 is a side view of an exhaust system and a portion of the internal combustion engine system, according to one embodiment.

Referring to FIGS. 1 and 2, there is shown an internal combustion engine system 10 (hereinafter "engine system 10") according to one embodiment. Engine system 10 can be used in an off-highway machine such as a tractor, a truck, or an excavator, for example. Engine system 10 could also be implemented in an engine-generator set, a pump, a compressor, or still another machine such as an on-highway vehicle or a marine vessel. Engine system 10 includes an engine 12 having a cylinder block 14. Cylinder block 14 may include therein any number of cylinders in any suitable arrangement. Engine 12 may be a compression-ignition engine including pistons within cylinder block 14 structured to compress a mixture of a fuel, such as a liquid diesel distillate fuel, and air to an autoignition threshold in the cylinders. The present disclosure is not thereby limited, however, and engine 12 could be spark-ignited, a dual fuel engine that is liquid pilot-ignited operating on both a liquid fuel and a gaseous fuel, or still another type.

Engine system 10 further includes an exhaust system 16 including a turbocharger 18 having a compressor and a turbine (neither shown) coupled with the compressor and including a turbine outlet, in a generally conventional manner. Exhaust system 16 also includes an exhaust conduit 20 having an upstream conduit end 22 connected to turbocharger 18 to receive a flow of exhaust from the turbine outlet, and a downstream conduit end 24. Exhaust conduit 20 forms a first turn 26 and a second turn 28 between upstream conduit end 22 and downstream conduit end 24, and may include bellows 30 between first turn 26 and second turn 28. As shown in FIG. 1, exhaust system 16 may include two bellows. Employing bellows in the configuration illustrated can enable a stream of exhaust to separate, and then recombine. Bellows 30 could also enable some flexing and movement between and among various components of engine system 10 as might be experienced in some applications. Exhaust system 16 can also include aftertreatment equipment including, but not limited to, a particulate filter or "DPF," a diesel oxidation catalyst or "DOC," an ammonia oxidation catalyst or "AMOX," and an exhaust stack or tail pipe structured to discharge exhaust treated in exhaust system 16. Exhaust system 16 may also be equipped with a variety of sensors such as temperature sensors, NOx sensors, pressure sensors, or still others coupled to an electronic control system for operating exhaust system 16 as further discussed herein.

Exhaust system 16 thus further includes an aftertreatment system 32. Aftertreatment system 32 includes an aftertreatment module 34 structured to perform selective catalytic reduction or "SCR". In a practical implementation, aftertreatment module 34 may include an SCR module sometimes referred to simply as "an SCR" operable to reduce emissions of oxides of nitrogen (collectively "NOx") by way of the introduction of a reductant, such as a urea liquid suspension, according to generally well-known principles. It should be appreciated that some or all of aftertreatment system 32 may be coupled to engine 12 and could be positioned in various locations relative to engine 12. For example, as illustrated in FIG. 1, aftertreatment module 34 is shown mounted vertically above engine 12 and attached to engine 12.

Figure 3:
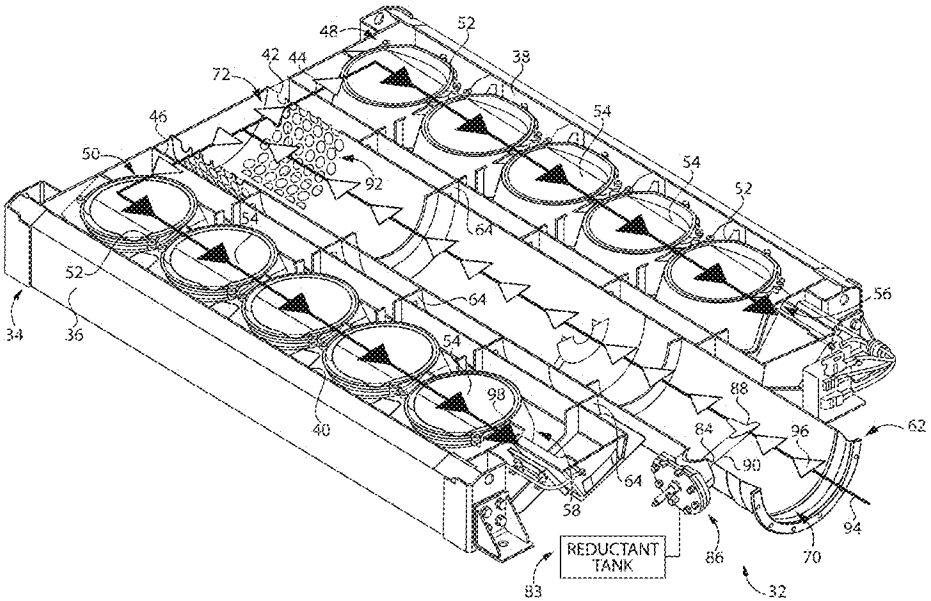
FIG. 3 is a sectioned view, in perspective, of an aftertreatment system, according to one embodiment.

Now also referring to FIG. 3, there are shown additional features of aftertreatment system 32 in further detail. Aftertreatment module 34 includes a module housing 36 forming a first housing wall 38, a second housing wall 40 oriented to face first housing wall 38, and a third housing wall 42 connecting first housing wall 38 and second housing wall 40. Aftertreatment module 34 may also include a first inner wall 44, and a second inner wall 46 spaced apart from first inner wall 44, providing a central area to accommodate an aftertreatment mixing tube 62, discussed further herein.

It should also be understood that each of inner walls 44 and 46 may be spaced apart in a manner which forms a first exhaust conduit 48 and a second exhaust conduit 50 between each inner wall 44 and 46 and adjacent housing wall 38 and 40, respectively. As will be further apparent from the following description, mixing tube 62 is structured for improved performance with respect to injection of a fluid, for example DEF, into a stream of exhaust from engine 12, and mixing of the injected fluid and exhaust, as well as improved packaging of aftertreatment system components.

Aftertreatment module 32 further includes a plurality of receptacles 52 positioned in first exhaust conduit 48 and second exhaust conduit 50. Each receptacle 52 may be designed to accommodate a catalyst brick 54 and can be strategically arranged within module housing 36 to form a first catalyst bank 56 and a second catalyst bank 58. Catalyst bricks 54 could be formed from various materials such as ceramics, or other suitable substrates, coated with active catalytic agents such as precious metal catalysts, base metal catalysts, and combinations of these or still others. As also depicted in FIG. 1, aftertreatment module 34 may also be equipped with at least one detachable door 60 or access panel, which is movably coupled to the module housing 36 to selectively cover or expose catalyst banks 56 and 58 for servicing, inspection and/or replacement. It should be understood that although described in the singular, "catalyst bank" is intended to include one or a plurality of catalyst banks. Two catalysts banks are illustrated and described herein. Aftertreatment mixing tube 62 can facilitate a feed of exhaust to be treated, as further discussed herein.

Figure 4:
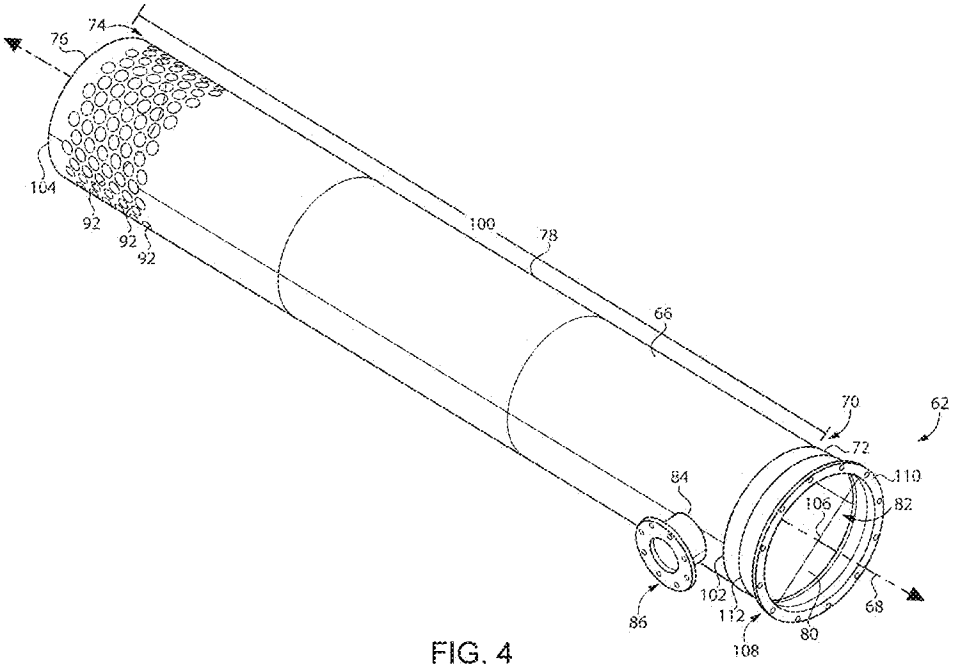
FIG. 4 is a perspective view of an aftertreatment mixing tube, according to one embodiment.

Aftertreatment mixing tube 62 (hereafter "mixing tube 62"), may be wholly, or at least partially, located in module housing 36, and positioned between first inner wall 44 and second inner wall 46. First inner wall 44 and second inner wall 46 are designed to flank mixing tube 62. Aftertreatment system 32 may also include hangers 64, configured to secure mixing tube 62 in a fixed position between first inner wall 44 and second inner wall 46. In a practical implementation, mixing tube 62 is supported in the housing laterally between first catalyst bank 56 and second catalyst bank 58. Referring also now to FIG. 4, mixing tube 62 includes a mixing tube body 66 defining a center axis 68 extending between an exhaust inlet 70, located in a first tube end 72, and an exhaust outlet 74, located in a second tube end 76. Mixing tube 62 also includes an outer tube surface 78, and an inner tube surface 80 circumferentially extending around center axis 68 and forming an exhaust passage 82.

As namely implied, mixing tube 62 is structured for mixing of exhaust and the injected fluid. Exhaust system 16 may also include a reductant tank 83 for storing an on-board volume of liquid reductant, such as a commercially available DEF, in a generally conventional manner. Description and discussion herein of "DEF" should not be understood to require any particular type of reductant. Mixing tube 62 may also include a DEF injection port 84 positioned proximate to first tube end 72, through which DEF is injected. DEF injection port 84 may be positioned at various distances relative to exhaust inlet 70, with further discussion on mixing tube dimensions and proportions provided hereinafter.

In a practical implementation, aftertreatment system 32 may also include a DEF injector 86, coupled to DEF injection port 84 and arranged to inject DEF through DEF injection port 84. DEF injector 86 may also include a tip piece 88 extending in exhaust passage 82, supported by an arm 90, and including one or more spray outlets oriented to inject DEF downstream. However, it should be appreciated that DEF injector 86 may be arranged to inject downstream, upstream, or still in another suitable direction. DEF injector 86 may operate to inject DEF into an exhaust stream continuously, at periodic intervals, or on an as-needed basis depending upon operating states and/or needs of engine 12 and aftertreatment system 32. For example, when engine 12 is operating at a rated load, DEF injector 86 might be operated relatively more frequently, whereas if engine 12 is idling DEF injector 86 may be operated relatively less frequently.

Mixing tube 62 also includes a plurality of perforations 92 located toward the second tube end 76. Perforations 92 may fluidly connect mixing tube 62 to both first catalyst bank 56 and second catalyst bank 58, thereby feeding the stream of exhaust and injected fluid to be treated. In a practical implementation, exhaust outlet 74 may include and be formed by perforations 92. As seen in FIG. 4, perforations 92 may include round or circular holes in some embodiments, and having an axial distribution and a circumferential distribution about center axis 68.

Referring back to FIG. 3, there is shown first catalyst bank 56 and second catalyst bank 58 arranged fluidly in parallel with each other. Mixing tube 62 defines a flow path 94, so as to simultaneously feed first catalyst bank 56 and second catalyst bank 58 via perforations 92. Flow path 94 advances in an incoming flow direction originating from exhaust inlet 70, then downstream toward exhaust outlet 74, and redirects in an outgoing flow direction 94, so as to feed first catalyst bank 56 and second catalyst bank 58. Another way to understand this principle is that mixing tube 62 defines a flow path advancing in a first direction 96, and first catalyst bank 56 and second catalyst bank 58 define flow paths advancing in a second direction 98 that is opposed to the first flow direction. For clarity, there are shown open arrows representing the first direction of the flow path, and shaded arrows representing the second direction of the flow path(s). It should be appreciated that first direction 96 may be the same, different from, or in opposition to, second direction 98, contingent upon operational and/or packaging requirements.

Referring back now to FIG. 4, in various applications, such as the context of engine 12, efficient mixing of DEF with exhaust gases is desirable for proper atomization and vaporization of the DEF in SCR systems. In absence of suitable mixing, the injected DEF may not be adequately vaporized, and instead form droplets that remain in exhaust passage 82 as a liquid, negatively affecting SCR performance, wasting DEF, or resulting in still other undesired outcomes. While longer or larger mixing components might improve atomization and vaporization in some instances, the size and shape of the available packaging space often limits the ability to practicably lengthen, widen, or otherwise vary the shape, size and/or relative proportions of exhaust system components to achieve a target extent of full DEF vaporization and mixing with exhaust.

Mixing tube 62 balances the need for efficient and effective vaporization of DEF with certain constraints of packaging, by providing a structure imparting sufficient residence time for DEF to vaporize in the host exhaust gases and/or surface area for impingement of liquid DEF to break up droplets. If a system component is too wide, for example, it may protrude above the profile of aftertreatment module 34 and/or conflict with construction and/or positioning of other parts of an aftertreatement module such as access doors. Similarly, if the mixing component is too long, aftertreatment module 34 would also be longer, potentially interfering with the available space needed for other components.

To this end, mixing tube 62 defines a mixing tube axial length dimension 100, defined parallel to center axis 68 and extending from a first terminal end 102 of mixing tube 62 to a second terminal end 104 of mixing tube 62. Mixing tube 62 also defines an inner diameter dimension 106 defined normal to mixing tube axial length dimension 100. Mixing tube inner diameter dimension 106 may be about 400 millimeters or greater in some embodiments. In a practical implementation, mixing tube inner diameter dimension 106 may be about 406 millimeters. Mixing tube axial length dimension 100 may range from about 2595 millimeters to about 2615 millimeters in some embodiments. In a refinement, mixing tube axial length dimension 100 can range from about 2597 millimeters to about 2614 millimeters.

A ratio, defined as the ratio of mixing tube axial length dimension 100 to mixing tube inner diameter dimension 106 herein, may be at least 5.9. In one example, the ratio may range from about 5.9 to about 6.7. In a refinement, the ratio may range from about 6.3 to about 6.5. In yet another refinement the ratio may range from about 6.3 to about 6.45, and still more particularly may be about 6.4 or exactly 6.4.

DEF injection port 84 may be positioned within a first 10% of the mixing tube axial length dimension originating at exhaust inlet 70 in some embodiments. Put differently, starting at first terminal end 102, the location of DEF injection port 84 may be within the first 10% of a full running distance to second terminal end 104. In other examples contemplated, DEF injection port 84 may be positioned about 189 millimeters from exhaust inlet 70, and/or within a distance from exhaust inlet 70 ranging from about 7% to about 10% of mixing tube axial length dimension 100, originating at exhaust inlet 70.

It should be understood that the terms "about," "approximately," or analogous relative terms as used in the present discussion, are intended to mean generally, and refer to values that are within an acceptable tolerance as would be understood by a person of ordinary skill in the aftertreatment system arts. For example, "about" may mean within conventional rounding, such that "about 6.5" means from 6.45 to 6.54, or another acceptable tolerance that would be understood by a person of ordinary skill in the aftertreatment system arts. Values not preceded by a relative term should be understood to mean within measurement error.

Mixing tube 62 may also include a transition piece 108 coupled to exhaust inlet 70. Transition piece may include a flange portion 110 and a skirt portion 112. Transition piece 108 is designed to accommodate potential size transitions between mixing tube 62 and any connected component, such as an exhaust feed conduit. In some embodiments contemplated, transition piece 108 may be present when mixing tube 62 is larger than the components connected to facilitate a size up transition, or smaller than components connected to facilitate a size down transition. In other embodiments, transition piece 108 may be omitted if the relative sizes of the components allow for a direct connection without the need for an intermediary element.

Figure 5:
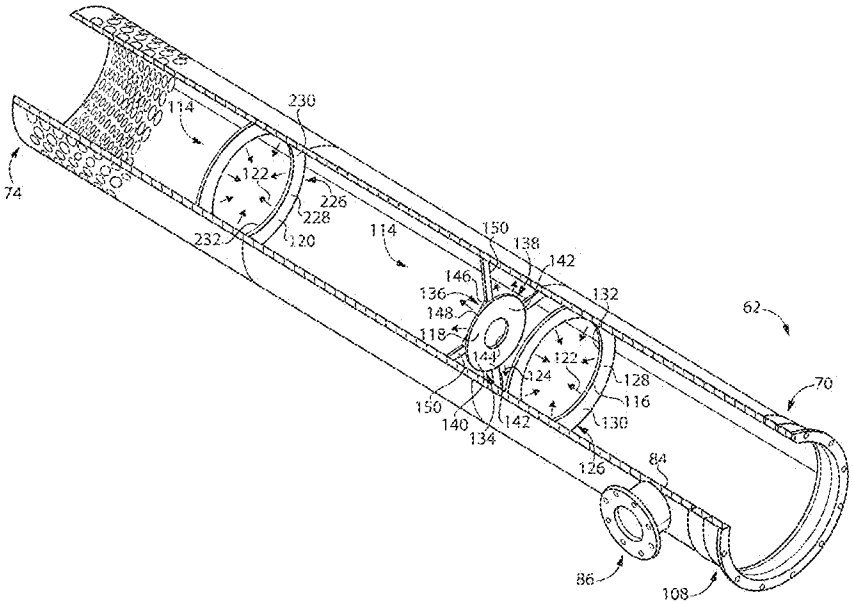
FIG. 5 is a sectioned view, in perspective, of the aftertreatment mixing tube of FIG. 4.

Referring also now to FIG. 5, there are shown additional features of mixing tube 62. Mixing tube 62 may further include a plurality of exhaust impingement elements 114. The plurality of exhaust impingement elements 114 may include three or more exhaust impingement elements. Exhaust impingement elements 114 may be installed in exhaust passage 82 and in contact with inner tube surface 80, or potentially may be integrally formed with mixing tube 62 at least in part. Also shown in FIG. 5, exhaust impingement elements 114 are serially arranged between exhaust inlet 70 and exhaust outlet 74. Each exhaust impingement element can be exposed to a flow of exhaust through exhaust passage 82, and oriented to deflect exhaust and injected DEF in radial directions for mixing. For example, one exhaust impingement element 114 may be an upstream converger, and another one of exhaust impingement elements 114 may be a downstream converger. In another example, one exhaust impingement element 114 may be a diverger. In a practical implementation, mixing tube 62 includes a first exhaust impingement element 116, a second exhaust impingement element 118, and a third exhaust impingement element 120.

First exhaust impingement element 116 and third exhaust impingement element 120 may be oriented to deflect exhaust and injected DEF in a first radial direction 122. Second exhaust impingement element 118 may be positioned axially between first exhaust impingement element 116 and third exhaust impingement element 120, and oriented to deflect exhaust in a second radial direction 124. The first radial direction may be a radially inward direction, so as to cause a convergence of exhaust flow and injected DEF. The second radial direction may be a radially outward direction, so as to cause a divergence of exhaust flow and injected DEF. When DEF is injected into a stream of exhaust, at least some of the injected DEF liquid can contact each exhaust impingement element 114, causing the DEF droplets to break apart.

Causing divergence and/or convergence may also affect the velocity and pressure of the fluids flowing through aftertreatment mixer 62. It should be appreciated that other components of each exhaust impingement element 114, or alternative exhaust impingement elements to those disclosed herein, could be structured to deflect, break up, swirl, or otherwise displace the flow stream for increased mixing.

It should be noted that description of the structure and functioning of first exhaust impingement element 116 is generally applicable to third exhaust impingement element 120 by way of analogy. First exhaust impingement element 116 may include an annular first converger body 126 located radially outward in exhaust passage 82. First converger body 126 may include a first converger side 128 having a first exhaust impingement surface 130, and a second converger side 132. Third exhaust impingement element 120 may include an annular second converger body 226 located radially outward in exhaust passage 82. Second converger body 226 may include a first converger side 228 having a third exhaust impingement surface 230, and a second converger side 232.

Second exhaust impingement element 118 may include a first portion 134 and a second portion 136. First portion 134 may include an annular diverger body 138 centrally located in exhaust passage 82. Diverger body 138 may include a first diverger side 140 having a second impingement surface 142, and a second diverger side 144. Second portion 136 may include an exhaust impingement element frame 146. Exhaust impingement element frame 146 may include a central support 148 attached to a plurality of legs 150. As depicted, legs 150 extend diagonally from central support 148 to fix first portion 134 in a centrally located position. It should be noted that diverger body 138 may be sized smaller in comparison to each converger body 126 and 226.

Placement of first exhaust impingement element 116, second exhaust impingement element 118, and third exhaust impingement element 120 relative to other components of mixing tube 62 may vary, contingent upon the specific application. In one example, DEF injection port 84 can be positioned closer to exhaust inlet 70 than to first exhaust impingement element 116. In another example, the second exhaust impingement element 118 may be positioned closer to first exhaust impingement element 116 than to third exhaust impingement element 120. In yet another example, the first exhaust impingement surface 130 may be positioned closer to DEF injection port 84 than to exhaust outlet 74, or within a distance extending about 25% of mixing tube axial length dimension 96, originating at exhaust inlet 70. Put differently, starting at first terminal end 102, the location of first exhaust impingement surface 116 may be within the first 25% of a full running distance to second terminal end 104. In a practical implementation, first exhaust impingement element 116, second exhaust impingement element 118, and third exhaust impingement element 120 may be collectively spaced apart at a distance defined from first exhaust impingement element 116 to third exhaust impingement element 120 ranging from about 43% to about 46% of mixing tube axial length dimension 96. In this particular example, first exhaust impingement element 116 and third exhaust impingement element 120 are spaced apart approximately 1116 millimeters. It should be understood that the arrangement of each exhaust impingement element (114) is exemplary, and numerous alternative combinations and variations are within the scope of the present disclosure.

INDUSTRIAL APPLICABILITY

Engine 12 operates by compressing air in a cylinder, then injecting diesel fuel, which is compression-ignited to drive the pistons. This process generates power for rotating a load, and also produces exhaust. Exhaust gases flow through turbocharger 18, rotating the turbine as they exit engine 12. Exhaust may then advance through aftertreatment system 32 for emissions reduction purposes. As a part of the emission control process, DEF can be injected into the exhaust stream. When DEF is combined with exhaust gases conveyed through an SCR, undesired NOx can be converted to nitrogen and water generally. Mixing tube 62 balances the limited packaging space available in certain aftertreatment systems, while optimally providing for increased mixing of DEF and exhaust.

Referring to the drawings generally, but in particular now also to FIG. 5, there are shown arrows representing radial directions of deflection, as mentioned above. As will be apparent from the foregoing description, mixing tube 62 may include structures for enhanced mixing and also features that pertain to the proportions and dimensions of the components. The structural features of mixing tube 62 may function in cooperation with one another, though each may also function independently. Accordingly, embodiments are contemplated where mixing tube 62 includes no specific exhaust impingement features and is structured only for optimized residence time. Other embodiments may implement exhaust impingement features as disclosed herein but having dimensions and/or proportions ranging beyond those specifically taught in the present disclosure. In still further embodiments, mixing tube 62 may include both exhaust impingement elements and relative proportions and/or dimensions for optimized residence time.

Operating aftertreatment system 32 may include injecting DEF into a flow of exhaust passing through exhaust passage 82 of aftertreatment mixing tube 62. Operating aftertreatment system 32 may also include feeding the exhaust and injected DEF toward an outlet of mixing tube 62 fluidly connected to first catalyst bank 56 and second catalyst bank 58. The exhaust and injected DEF advances in an incoming flow direction, and then redirects to an outgoing flow direction through first catalyst 56 and second catalyst 58 that is in opposition to the incoming flow direction. Operating aftertreatment system 32 may further include increasing the mixing of the exhaust and injected DEF at least in part by impinging the exhaust and injected DEF upon the serially arranged exhaust impingement surfaces of aftertreatment system 32. Operating aftertreatment system 32 may further include converging, then diverging, then again converging, the flow of exhaust and injected DEF by way of the impingement upon the respective impingement surfaces. Exhaust that is treated in aftertreatment system 32 can then be discharged to atmosphere.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. An aftertreatment mixing tube comprising:

a mixing tube body having an exhaust inlet located in a first tube end, an exhaust outlet located in a second tube end, and a mixing tube side wall extending from the exhaust inlet to the exhaust outlet and having an inner tube surface and an outer tube surface, each circumferentially extending around a center axis, and the inner tube surface forming an exhaust passage;

the mixing tube body further including a diesel exhaust fluid (DEF) injection port extending radially inward relative to the center axis between the inner tube surface and the outer tube surface of the mixing tube sidewall, and positioned proximate to the first tube end; and the mixing tube defining a mixing tube inner diameter dimension, and a mixing tube axial length dimension, and a ratio of the mixing tube axial length dimension to the mixing tube inner diameter dimension ranges from 5.9 to 6.7.

2. The aftertreatment mixing tube of claim 1 wherein the exhaust outlet includes a plurality of perforations.

3. The aftertreatment mixing tube of claim 2 wherein the plurality of perforations have an axial distribution and a circumferential distribution about the center axis.

4. The aftertreatment mixing tube of claim 1 wherein the ratio of the mixing tube axial length dimension to the mixing tube inner diameter dimension ranges from about 6.3 to about 6.5.

5. The aftertreatment mixing tube of claim 1 wherein the ratio of the mixing tube axial length dimension to the mixing tube inner diameter dimension is 6.4.

6. The aftertreatment mixing tube of claim 1 wherein the mixing tube axial length dimension ranges from about 2595 millimeters to about 2615 millimeters, and the mixing tube inner diameter dimension is about 400 millimeters or greater.

7. The aftertreatment mixing tube of claim 1 wherein the DEF injection port is positioned within a first 10% of the mixing tube axial length dimension originating at the exhaust inlet.

8. An exhaust system comprising:

a housing;

a catalyst bank located in the housing; and a mixing tube located in the housing and coupled to the catalyst bank, the mixing tube including an exhaust inlet located in a first tube end, an exhaust outlet located in a second tube end, and an inner tube surface circumferentially extending around a center axis and forming an exhaust passage;

the mixing tube body further including a diesel exhaust fluid (DEF) injection port positioned proximate to the first tube end;

the mixing tube defining a mixing tube inner diameter dimension of about 400 millimeters or greater, and a mixing tube axial length dimension ranging from about 2595 millimeters to about 2615 millimeters; and the mixing tube defines an exhaust flow path advancing in a first axial direction between the first tube end and the second tube end, and the housing defines an exhaust flow path advancing in a second axial direction opposed to the first axial direction through the catalyst bank.

9. The exhaust system of claim 8 further including a second catalyst bank coupled to the mixing tube, and the first catalyst bank and the second catalyst bank are arranged fluidly in parallel with each other.

10. The exhaust system of claim 9 wherein the exhaust outlet includes a plurality of perforations fluidly connected to both the first catalyst bank and the second catalyst bank.

11. The exhaust system of claim 10 wherein the mixing tube is supported in the housing laterally between the first catalyst bank and second catalyst bank.

12. The exhaust system of claim 8 wherein a ratio of the mixing tube axial length dimension to the mixing tube inner diameter dimension ranges from about 6.3 to about 6.5.

13. The exhaust system of claim 8 wherein the mixing tube axial length dimension ranges from 2597 millimeters to 2614 millimeters.

14. The exhaust system of claim 8 further comprising a DEF injector coupled to the DEF injection port.

15. A method of operating an aftertreatment system comprising:

injecting diesel exhaust fluid (DEF) into exhaust passing through an aftertreatment mixing tube defining a center axis, an axial length dimension defined parallel to the center axis, an inner diameter dimension defined normal to the axial length dimension, and a ratio of the mixing tube axial length dimension to the mixing tube inner diameter dimension ranging from 5.9 to 6.7;

feeding a flow of the exhaust and injected DEF toward an exhaust outlet of the aftertreatment mixing tube fluidly connected to a first catalyst bank and a second catalyst bank; and increasing mixing of the exhaust and injected DEF at least in part by impinging a flow of the exhaust and injected DEF upon a plurality of exhaust impingement surfaces serially arranged between an exhaust inlet and the exhaust outlet of the aftertreatment mixing tube.

16. The method of claim 15 wherein the increasing mixing further includes converging, then diverging, and then converging, the flow of the exhaust and injected DEF by way of the impingement upon the plurality of impingement surfaces.

17. The method of claim 15 wherein the mixing tube is supported in the housing laterally between the first catalyst bank and the second catalyst bank.

18. The method of claim 17 wherein the feeding a flow of the exhaust and injected DEF includes feeding the exhaust and injected DEF in an incoming flow direction, and then redirecting the flow of the exhaust and DEF to an outgoing flow direction through the first catalyst bank and the second catalyst bank that is opposed to the incoming flow direction.

19. The method of claim 15 further comprising promoting vaporization of the injected DEF based upon a residence time of the injected DEF in the aftertreatment mixing tube in cooperation with the impingement upon the plurality of impingement surfaces.

* * * * *